United States Patent [19]

Glomb et al.

[11] Patent Number: 4,918,958

[45] Date of Patent: Apr. 24, 1990

[54] DEVICE FOR BENDING CONICAL WIRES

[75] Inventors: Reiner Glomb; Ralf Fangmeier, both of Solingen, Fed. Rep. of Germany

[73] Assignee: Kieserling & Albrecht GmbH & Co., Werkzeugmaschinenfabrik, Fed. Rep. of Germany

[21] Appl. No.: 5,163

[22] PCT Filed: Oct. 18, 1985

[86] PCT No.: PCT/DE85/00403

§ 371 Date: Dec. 5, 1986

§ 102(e) Date: Dec. 5, 1986

[87] PCT Pub. No.: WO86/04837

PCT Pub. Date: Aug. 28, 1986

[30] Foreign Application Priority Data

Feb. 20, 1985 [DE] Fed. Rep. of Germany ..... 3505739

[51] Int. Cl.[5] ..... B21D 7/08; B21B 37/02

[52] U.S. Cl. ..... 72/10; 72/17; 72/135; 72/175

[58] Field of Search ..... 72/10, 12, 17, 135, 72/173, 175

[56] References Cited

U.S. PATENT DOCUMENTS 3,640,112 2/1972 Meyfarth et al. ..... 72/138
3,859,830 1/1975 Jeuken et al. ..... 72/10
4,164,133 8/1979 Damman ..... 72/12
4,412,438 11/1983 Tjushevsky et al. ..... 72/10

FOREIGN PATENT DOCUMENTS 1179534 10/1964 Fed. Rep. of Germany .
1752397 2/1971 Fed. Rep. of Germany .
148162 11/1979 Japan .

*Primary Examiner*—Daniel C. Crane
*Attorney, Agent, or Firm*—Klein & Vibber

[57] ABSTRACT

The invention relates to a bending apparatus for wires having a cross section which varies according to their lengths, and comprising two cylindrical sections and an interleaved conical section. The wire is bent by means of three rollers. The bending roller is mounted on a carriage and determines the bending degree imparted to the fed wire. The wire is bent despite its variable diameter so that it is deposited with a regular curvature on the reception plate. To this effect, the curvature of the conical section is changed between the correct curvature of the thinner cylindrical section of the wire and that of the thicker cylindrical section of the wire. It only requires a simple switching at an appropriate time to obtain a sire bobbin which may be deposited on the reception plate. The appropriate switching time is situated between 20% and 60%, but preferably between 30% and 40%, and is calculated from the beginning of the wire diameter increase.

5 Claims, 1 Drawing Sheet

DEVICE FOR BENDING CONICAL WIRES

The invention relates to an improved method of bending conical wire, and also to a new apparatus for the performance of said improved method.

DESCRIPTION OF THE PRIOR ART

It is known in the art to coil wire into bobbins for the purpose of transportation or storage. Also known are bending devices which can be used for wire. Generally, a straight wire is guided into the device, bent into a circular shape onto a revolving plate, spool or the like, and forms a cable bobbin thereon.

These kind of devices fail when the wire does not have a constant cross section, as is the case, for example, of coil springs with progressive or diminishing spring characteristics. Reference here is to wire intended for coil springs with progressive spring characteristic, which is only subsequently divided into longitudinal sections which are used when winding the individual springs. Wire which has two or more longitudinal sections, with varying cross sections, becomes flattened without alteration of the setting of the bending machine and thus becomes unsuitable for transport and further processing. Preferably, the manufacture of this wire with variable smaller and larger diameter should result by dish means.

Adjusting the setting of the bending machine to each cross section and its moment of inertia, as well as to the yield point of each wire material that requires bending, is mathematically very difficult and requires a great amount of electronic expenditure.

SUMMARY OF THE INVENTION

Accordingly, the object of the present invention is to provide a novel method by which wires, having varying cross sections along their length, can be wound into a ring shaped coil or bobbin, and an apparatus which can perform the novel method herein described.

DESCRIPTION OF THE METHOD

The method is based upon the knowledge that a switching mechanism, theoretically a step function, meaning, in other words, a sudden transition from the corresponding flexure of the larger cross section wire to the flexure corresponding to the smaller cross section wire, is sufficient for bending a transportable wire bobbin. The switching from the smaller to the larger diameter of the wire may be effected in two steps for sequentially arranged cylindrical wire sections with a very large discrepancy in diameter. A time delay device, e.g. a throttle or pressure regulating valve, can be designed in the hydraulic drive means which extends the time of the switching process, thereby preventing a kink in the wire.

The preferred embodiment for spring wires used with automobiles can be of the type, for example, where the wire has conical lengths of not more than 2 meters, and whose coils have a diameter of under 3 meters.

The time for switching the amount of bending from one corresponding to the wire with the major diameter to the amount suitable for the wire section with the minor diameter is chosen at a point, when the section of the wire with increasing or decreasing diameter is passing between the bending rollers. The length of this section is taken as 100%. The degree of bending is switched as 20% to 60% of that length, measured from the end of said cylindrical section with the smaller diameter. The length of the conical section is stored in a control unit. When the transition of the cylindrical section with the minor diameter to the conical section is passing the feeler rollers (measuring device) a signal is given to the control unit. A time delay is calculated in the control unit with regard to the distance between the feeler rollers and the bending rollers and to the speed of advance of the wire. The degree of bending is switched, when that range of the conical section, namely 20 to 60% of the conical length, measured as above, is passing the bending rollers. If the feeler rollers indicate the transition from the cylindrical section with the major diameter to the conical section the switching in the degree of bending is effected, when 40 to 80% of the conical length have passed the bending rollers, i.e. 20 to 60% measured from the opposite end of the conical section with the smaller diameter. As the length of the conical wire section is 100 percent, it is known that the distance of the wire which has passed through the feeler rollers is proportional to the change in diameter of the wire. Preferably the range of length for switching the degree of bending is chosen at 30% to 40% of said section. The selection of the time period within these indicated ranges depends upon whether the wire, having a variable diameter longitudinal section, is conically formed, or whether the contour of this longitudinal section is convexly or concavely shaped with respect to the conical contour. The switchover time or length for a contour essentially convex with respect to the conical contour is set within the given ranges close to the cylindrical section having the smaller diameter. With a concave formation one selects the change over range having the greater value of the given ranges. Ultimate diameters are the diameters at the ends of the sections of length of the wire having variable diameters. Only those sections of length are regarded where the diameter is constantly increasing or constantly decreasing.

DESCRIPTION OF THE APPARATUS

The novel apparatus for implementing the method generally described above is characterized by at least two stops between which the sliding carriage with the bending roller is guided and driven back and forth. A switching mechanism provides for the timely switching of the carriage with the bending roller between the two positions characterized by the placement of the stops. The end position of the bending roller with the greater wire bending degree or flexure represents the position for smaller wire diameters, and the end position of the carriage with the bending roller for lesser flexure represents the position for larger wire diameters.

In accordance with another preferred embodiment of the invention, both stops are adjustable, and lie within the range of appropriate amounts of bending for wires to be coiled by the apparatus, the total transport range of the carriage is normally greater than the transport range as determined by the stops, the latter being adjustable for a single wire contour with cylindrical longitudinal sections having variable diameters.

In another preferred embodiment of the invention, the adjustment or drive for the carriage, with the bending roller, is hydraulic.

A further preferred embodiment of the invention has a measuring apparatus arranged on the feed side of the bending roller. The measuring apparatus is connected with the switching mechanism for purposes of control, and securely sets the correctly selected time for switching from the bending of the smaller to the larger wire cross sections and vice versa for each wire profile. The measuring apparatus preferably measures the diameter of the wire arranged between its measuring elements.

BRIEF DESCRIPTION OF THE DRAWINGS

These and other preferred embodiments of the invention will become apparent with reference to the following detailed specification and to the following drawings wherein.

DETAILED SPECIFICATION

Figure 2:
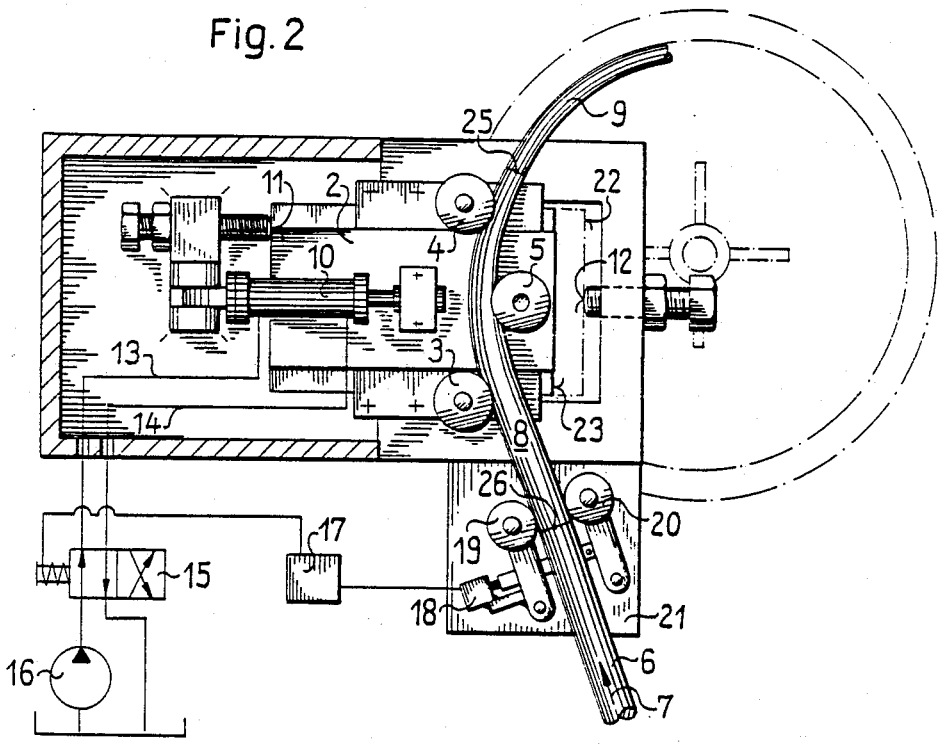
FIG. 2 is a bottom view of the bending apparatus looking through line II—II of FIG. 1.
Figure 1:
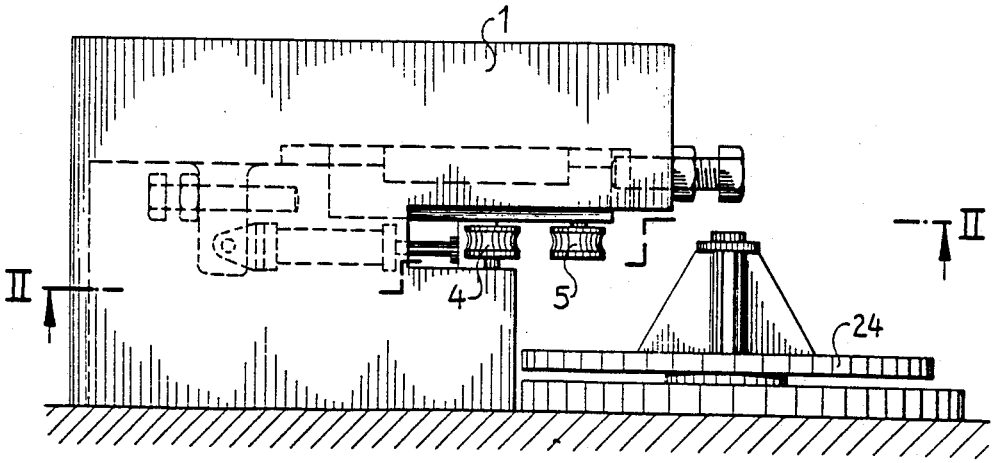
FIG. 1 is a side view of the bending apparatus.

In FIG. 1, a group of 3 rollers, 4, and 5, are shown on the underside of a machine from 1 through which a wire is fed in the direction of the arrow 7. The wire consists of three variable longitudinal sections. The longitudinal sections 6 and 9 are cylindrical, the section 8 is conical. The latter is enclosed by the ultimate diameters 25 and 26. Only a partial section of an infinitely long wire is shown. The wire is repeatedly arranged in interchangeable sequence with cylindrical and conical sections. The wire is bent into a coil in the bending apparatus and deposited onto a revolving plate 24 arranged underneath the bending apparatus.

The rollers 3, 4 are fixed stationary in the machine frame 1. The bending roller 5 is arranged on a carriage 2, guided on the machine frame 1, which slides at a right angle to the direction of passage (arrow 7) of the wire. The movement of the carriage 2 is accomplished by means of a hydraulic cylinder 10. The rollers are rotated by known means which is not shown.

The direction of movement of the carriage 2 is determined by a switching mechanism 15 which is constructed as a 2/2 valve and is switched from a control unit 17. Two stops 11, 12 determine the end positions 22, 23 of the carriage. A pump 16 puts the carriage 2 into motion and moves the same against one of the two stops 11, 12. When the carriage 2 abuts the stop 11, the cylindrical longitudinal section 9 of the wire receives the correct curvature so that the wire fits onto the revolving plate 24 with respect to its curvature radius in its relieved state. When the carriage 2 abuts the stop 12, the correct cuvature is set for the cylindrical longitudinal section 6 of the wire having the thicker diameter. The carriage 2 is moved from one end position 23 to the other end position 22 be means of the carriage's switching mechanism 15, the measuring apparatus 21 and the control unit 17 which initiates the switching process.

The bending apparatus has a measuring apparatus 21 at its entrance which determines the changes in wire diameter with the assistance of two feeler rollers 19, 20 (or other measuring device) and sends an impulse through a toggle switch 18 to the control unit 17.

The bending device functions as follows:

The pre-setting of the bending apparatus results by fixing the two end positions of the carriage by means of the stops 11 and 12 for the coiling of the wire and its contour, and by determining the switching time of the control unit, i.e. the switching diameter of the wire, independent of the contour of section 8. The switching results within a diameter range which lies within 20% to 60%, and preferably between 30% to 40%, of the diameter increase proceeding from the smaller diameter to the larger diameter. This mathematically determined diameter takes into consideration the possible contour deviations of the conical form of section 8. The switch point for a considerably narrower contour, as that shown for the conical section 8, will lie at the top end of the indicated range; while a largely convex contoured section will have a switch point lying near the lower values of the indicated range.

The diameter of the wire is determined by the measuring apparatus while feeding in the wire according the direction of arrow 7, and the switching mechanism 15 is correspondingly set for the indicated diameter. If required, i.e. if a wire is fed in having a thick cylindrical section, then the carriage is moved up against the stop 12. As soon as the measuring apparatus determines the predetermined diameter value for switching, because a conical section is passing through the measuring apparatus at that moment, the carriage 2 is moved with the bending roller 5 against the other stop with a timing delay effected by means of a component in the control unit 17. This occurs by means of a switching process effected at the switching mechanism which reroutes the supply of hydraulic fluid from the conduit 13 to the conduit 14 or vice versa. Apart from the empirical or mathematical determination of the switch point, no consideration of the contour or length of the longitudinal section 8 connecting the two cylindrical section 6, 9 results during the switching.

While there have been described various preferred embodiments of the invention, it will be apparent to those skilled in the art, that variations may be made thereto, without departing from the spirit and the scope of the appended claims.

We claim:

1. A process for bending and coiling wire with at least one cylindrical section and at least one longitudinal section having an increasing or decreasing cross-section over its length wherein the wire is bent while being fed between at least three bending rollers with approximately equal curvature along the range of cylindrical longitudinal sections, comprising the steps of coiling said wire by feeding said wire between three bending rollers;

changing the amount of bending of the wire during coiling within the range of the longitudinal sections having increasing or decreasing cross sections at a point on the longitudinal section having a variable diameter by means of measuring said change in diameter of said wire by a measuring device and switching from the amount of bending appropriate for the smaller ultimate diameter to the amount of bending appropriate for a larger diameter, or vice versa, based upon said measuring;

the switching taking place at a point at which the minor ultimate diameter of the section having the varying diameter is located a predetermined distance from the bending rollers, which distance is 20% to 60% of the length of the section with the varying diameter.

2. A process for bending and coiling the wires according to claim 1, wherein the switching is effected at a point at which the minor ultimate diameter of the wire passing through the bending rollers is at a distance of 30% to 40% of the length of the section of the wire having an increasing or decreasing cross-section from the bending rollers.

3. An apparatus for bending and coiling wire with at at least one cylindrical section and at least one longitudinal section having an increasing or decreasing cross-section over its length, comprising a machine frame having at least three rollers mounted thereon, one of said rollers is a bending roller which is mounted on a carriage, and is guided and attached onto the machine frame; and a mechanical drive for driving the carriage, two stops which limit the two end positions of the driven carriage which determines the shape of the wire passing through the rollers on the carriage;

a measuring apparatus arranged on the machine frame and operatively connected through a switching mechanism to said bending roller; and a switching mechanism operatively connected to the carriage for positioning said bending roller alternately at said two stops thereby switching from the amount of bending appropriate for the smaller ultimate diameter to the amount of bending appropriate for a larger diameter, or vice versa based upon measurements obtained by said measuring apparatus, the switching taking place at a point at which the minor ultimate diameter of the section having the varying diameter is located a predetermined distance from the bending rollers, which distance is 20% to 60% of the length of the section with the varying diameter.

4. An apparatus for bending wires according to claim 3, wherein both stops are adjustable, and lie within the range of appropriate amounts of bending for the wires to be bent by the apparatus.

5. An apparatus for bending of wires according to claim 3, wherein the drive is hydraulic.

* * * * *